US005329711A

United States Patent [19]

Dewey

[11] Patent Number: 5,329,711

[45] Date of Patent: Jul. 19, 1994

[54] CREASE FOLD CALENDAR

[76] Inventor: Edward S. Dewey, 10 Commercial Warf West, Ste. 401, Boston, Mass. 02110

[21] Appl. No.: 58,786

[22] Filed: May 10, 1993

Related U.S. Application Data

[63] Continuation of Ser. No. 915,525, Jul. 20, 1992.

[51] Int. Cl.[5] ..... G09D 3/04

[52] U.S. Cl. ..... 40/119; 40/107; 283/2

[58] Field of Search ..... 40/107, 119, 121; 283/2, 4; 281/2, 5

[56] References Cited

U.S. PATENT DOCUMENTS

| | | | |
|---|---|---|---|
| 990,211 | 4/1911 | Richardson | 40/119 |
| 1,487,520 | 3/1924 | Ringler | 40/122 X |
| 1,507,345 | 9/1924 | Doyle | 40/121 |
| 2,027,286 | 1/1936 | Pendergast | 40/107 |
| 2,393,809 | 1/1946 | Potter | 283/2 |
| 3,883,971 | 5/1975 | Weiss | 40/119 |

FOREIGN PATENT DOCUMENTS

| | | | |
|---|---|---|---|
| 1091446 | 1/1954 | France | 283/2 |
| 1229709 | 6/1961 | France | 40/119 |
| 257433 | 7/1973 | France | 40/121 |
| 10508 | of 1901 | United Kingdom | 40/121 |

*Primary Examiner*—Brian K. Green

*Attorney, Agent, or Firm*—Chapin, Neal & Dempsey

[57] ABSTRACT

An accordion-folded calendar sheet printed on a continuous web of paper has sufficient blank spaces adjacent each date thereof to allow the user to record notations and has transverse perforations which separate the calendar paper into consecutive two-week increments. The calendar sheet is foldable at each fourth perforation and disposed in a holder to display an eight-week portion of the calendar web. With the passage of time successive increments can be arrayed in coplanar orientation for simultaneous viewing of eight-week portions of the calendar web which displays the current date as well as previous and subsequent weeks without having to flip between pages of the calendar.

5 Claims, 1 Drawing Sheet

FIG. 1
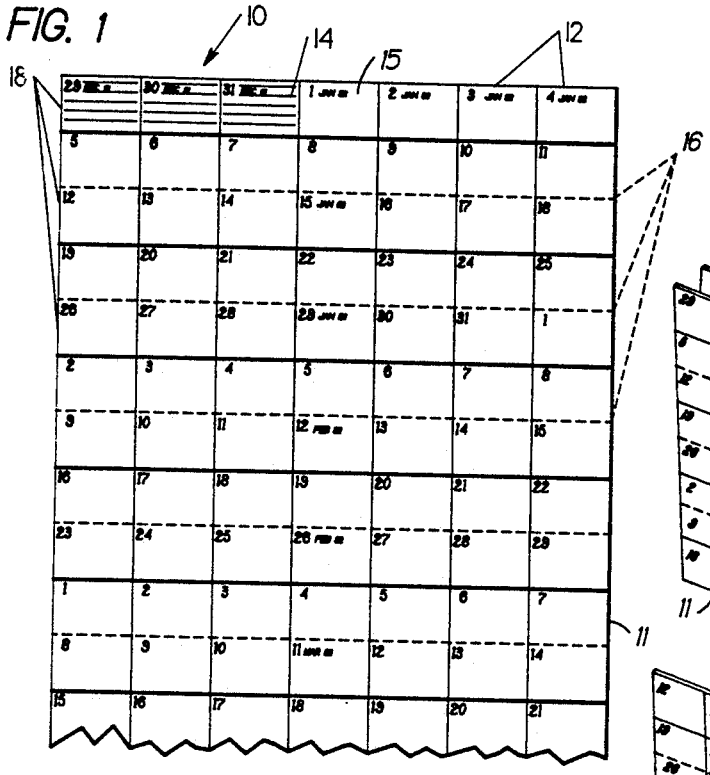
FIG. 2
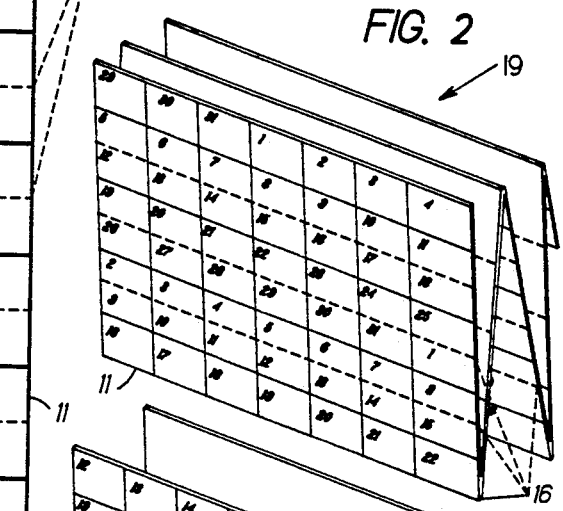
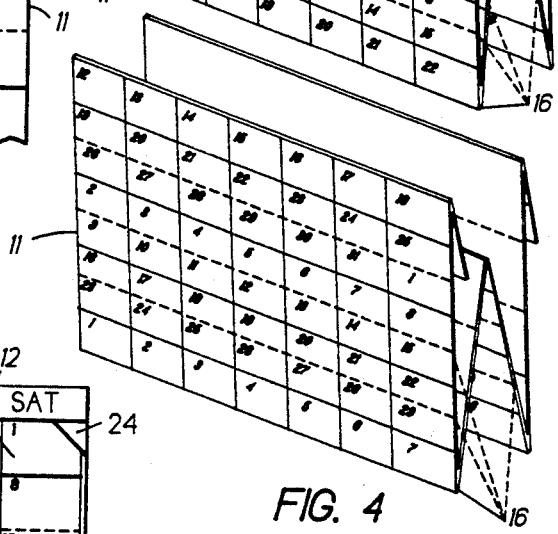
FIG. 4
FIG. 3
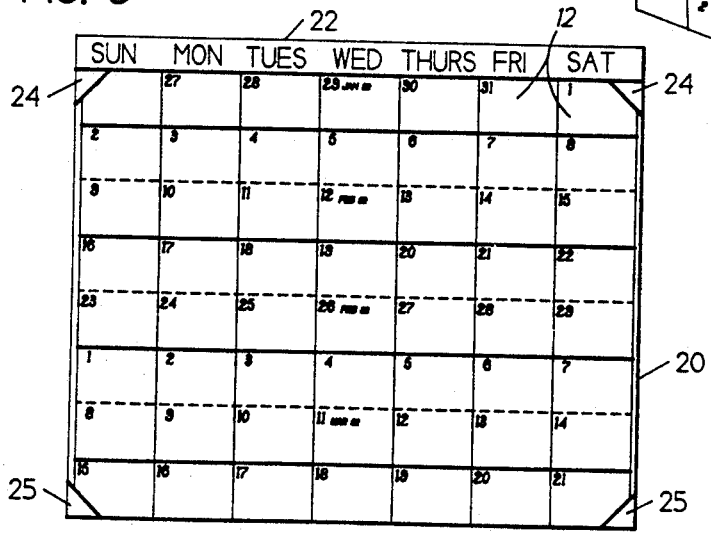

CREASE FOLD CALENDAR

This is a continuation of copending application Ser. No. 07/915,525 filed on Jul. 20, 1992.

FIELD OF THE INVENTION

This invention relates to calendars and, more particularly, to desk-top or wall calendars of the type used for recording appointments.

BACKGROUND OF THE INVENTION

Most conventional calendars are arranged to enable the simultaneous viewing of one complete calendar month and viewing any subsequent or preceding month usually requires the flipping of pages of the calendar. Additionally, there are many types of recording or diary calendars which are printed to include blank spaces for each day that are large enough to allow the user to record meetings, appointments or diary entries thereon.

Presently available calendars have several disadvantages, one being that the calendars do not enable ready reference to entries made before or after the current month. With such calendars, the user would therefore have to turn the pages of the calendar one way or the other in order to view the preceding or subsequent weeks. While it is not uncommon for calendars to have additional months displayed on each page, invariably the additional months are too small for adequately recording appointments or other diary type entries. Indeed, most such multiple month per page calendars are designed simply to enable one to reference dates preceding or following the current month.

The conventional calendars which provide the most space for the user to record appointments and the like, are those which display for simultaneous visual reference only a single week or month at a time. Thus, the user who may desire to view at the same time the current time period as well as the preceding and subsequent time periods, is forced to flip the several pages back and forth.

SUMMARY OF THE PRESENT INVENTION

An object of the invention is to provide a calendar arrangement which has sufficient blank space allocated for each date to facilitate recording of appointments, meetings and the like, which is divided into transverse incremental portions adapted to be folded and unfolded to reveal consecutive time periods and in which several of such portions may be unfolded to allow at least six weeks to be viewed simultaneously.

According to the invention, a desk calendar which displays six weeks or more at a time is printed on a continuous web of accordion-folded paper with scored lines or perforations every one, two or three weeks which allows the user to remove or fold under an expired one or two week increment and advance the calandar by unfolding an upcoming increment of the same interval. Thus, the calendar may be advanced successively to display at least six consecutive weeks for simultaneous viewing.

These and other objects, features and advantages of the present invention will become more apparent in light of the following detailed description of an exemplary embodiment thereof, as illustrated in the accompanying drawing.

BRIEF DESCRIPTION OF THE DRAWINGS

FIG. 1 is a plan view of a portion of a web which provides the calendar of the present invention;

FIG. 2 is a perspective view of the web of FIG. 1 folded in an accordion fashion to provide the calendar of the invention;

FIG. 3 is a plan view of the calendar of FIG. 2 installed in a holder of the invention;

FIG. 4 is a perspective view of the calendar of FIG. 3 with an upper expired portion folded underneath the uppermost sheet portion of the calendar.

DETAILED DESCRIPTION OF THE PREFERRED EMBODIMENTS

In FIG. 1, the calendar 10 is a continuous web of paper 11 which is printed on one side with a conventional calendar indicia. Each day of the calendar is represented by a square or rectangular portion 12, with seven such portions 12 positioned side-by-side horizontally so that one week spans the full width of the calendar 10. Each day portion 12 is provided with blank space to allow the user to record notations such as appointments, meetings or diary entries. Alternatively, parallel lines for recording information as shown at 14 may be used or omitted as desired and as otherwise shown in the drawings. The calendar may include appropriate notations of the applicable month and year as shown at 15 and for convenience of illustration a designation is shown for every other Wednesday. Unlike many conventional calendars, there is no break in the sequence of months. Rather, the portion 12 that represents the last day of a month is followed immediately in the next succeeding portion 12 with the first day of the next month (FIG. 3).

The paper web on which the calendar is printed may be similar to continuousfeed type computer paper. However, unlike standard computer paper in which perforations are placed at the end of standard sized pages, transverse fold lines, scored lines or perforations 16 separate the calendar paper into transverse incremental portions or strips 18. As shown in the preferred embodiment, each strip 18 includes a two-week period of the calendar, although each strip may include any weekly based interval less than a month, such as one, two, or three week periods.

As shown in FIG. 2, the web 11 is folded in accordion-fashion to form calendar 19 folded at every fourth perforation 16, or once for every eight week portion of the continuous web 11 of calendar 10. Folding the calendar in this manner allows successive eight week portions to be viewed at once and when so arrayed may be combined with a suitable binder, retainer or holder such as depicted at 20 in FIG. 3.

This arrangement produces a calendar of minimum bulk, a full year calendar requiring a thickness of only seven (7) layers of folded sheet portions. Alternatively, a multi-year calendar can be fitted into a holder 20 while still having fewer sheets than a standard writing pad of paper. As a result, when in place on a desk-top, the calendar will have a very low profile which only slightly interrupts the planar surface of the desk. Thus, the calendar in this configuration provides great utility while being relatively unobtrusive to the user.

Referring now to FIG. 3, the holder 20 may have the days of the week printed across an upper edge 22, each day being positioned directly above a corresponding column of rectangular portions 12 of the calendar. The folded calendar 19 may be disposed on the holder in any convenient manner, as by fitting the corners of the calendar under upper and lower corner pockets 24 and 25 respectively. The pockets 24 and 25 may be of a conventional type as commonly used for desk-top blotters and pads and are disposed at the corners of the backboard 20. In addition to being used on a desk top, the calendar as shown in FIG. 3 may also be hung on a wall using a hood or magnetic strip or any other suitable type of fastener.

Referring now to FIG. 4, when the user so desires, an expired transverse increment or two-week strip 18 can be removed from the upper corners 24 of the holder and folded under the upper calendar sheet 10 along the appropriate scored or perforated line 16 to be stored for future reference. Alternatively, instead of retaining the expired increment 18 for record purposes, it can simply be torn along its perforations 16 and discarded or retained separately as may be necessary or desirable for future reference. In either event, the upper edge of the outermost portion of the calendar web 11 is then moved upwardly and refolded into the upper corner pockets 24 while a subsequent two-week increment or strip 18 is being unfolded from the previously underlying sheet portion of the calendar. The calendar web 11 is then folded along the perforations 16 at the lower edge of the newly unfolded strip 18 and refitted onto the holder. In this manner, the simultaneously viewable eight-week portion of the calendar 10 has shifted upwards by two weeks by reversibly folding or removing the expired upper two-week strip 18 and exposing at the lower end of the visible outwardly facing sheet, a later two-week increment or strip 18. This invention thus provides the user with the ability to view a single eight-week calendar sheet which displays the current month as well as previous and subsequent weeks without requiring the user to flip between calendar pages regardless of whether any date within a given month is within the first or last week of a month.

It should be understood that any portion of a month or months could be included in the horizontal strip or transverse incremental portions separated by fold or tear lines and still remain within the scope of this invention. Furthermore, any number of incremental portions could be displayed for simultaneous viewing and remain within the scope of the invention.

Although the invention has been shown and described with respect to an exemplary embodiment thereof, it should be understood by those skilled in the art, however, that the foregoing and various other changes, omissions and additions in the form and detail thereof may be made therein without departing from the spirit and scope of the invention.

What is claimed is:

1. A recording calendar adapted to be used for recording diary entries for each date of a year of twelve months from January 1st to December 31st and fifty-two weeks, each seven day week commencing on a Sunday and ending on a Saturday, the recording calendar being imprinted with indicia including arabic numerals which correspond to each calendar date and other indicia delineating a substantial blank area which corresponds to each date thereof and being adapted to receive diary entries; the improvement comprising a web of paper of continuous length from one end to another end and a width defined by a left edge and a right edge, said numerals arranged in at least fifty-two rows, each of said rows comprising numerals disposed in laterally spaced relation across the web, the numerals in each of said rows being in chronological order from the left to the right edge of the web corresponding with the calendar dates and days of the week, a first of each of said numerals in each of said rows corresponding to a Sunday and a last of each of said numerals in each of said rows corresponding to a Saturday of each calendar month, said web including a plurality of scored lines spaced apart lengthwise of the web and extending laterally across the width thereof, said scored lines being spaced apart in a lengthwise direction of the web, a transverse increment being defined between each adjacent pair of said scored lines, each said increment consisting of from one to three of said rows, said web being foldable selectively along each of said scored lines for arranging in planar orientation at least two of said increments for the simultaneous visual display of consecutive weeks of a calendar year as defined by said increments whereby simultaneous visual reference can be made to diary entries prior to and after any particular date even where that date falls on a first or last day of any calendar month.

2. Recording calendar of claim 1, in which at least one of said increments is disposed on said web prior to a January 1st date and another of said increments is disposed after a December 31st date thereon.

3. Recording calendar of claim 1, in which each of said increments consists of two of said rows of numerals and in which at least one of said increments is disposed on the web prior to a January 1st date and another of said increments is disposed after a December 31st date thereon.

4. Recording calendar of claim 1, and further including a display means provided for holding the web with a planar display of at least six rows of numerals disposed in planar arrangement for simultaneous display thereof.

5. Recording calendar of claim 1, in which said scored lines are adapted for selective folding and tearing therealong.

* * * * *